United States Patent [19]

Woodruff

[11] 3,949,538

[45] Apr. 13, 1976

[54] ANIMAL TRAINING HALTER

[76] Inventor: Dale K. Woodruff, Rte. 1, Box 171 E, Spokane, Wash. 99204

[22] Filed: Dec. 23, 1974

[21] Appl. No.: 535,565

[52] U.S. Cl. ..... 54/24
[51] Int. Cl.[2] ..... B68B 1/02
[58] Field of Search ..... 54/24, 85, 71

[56] References Cited

UNITED STATES PATENTS

| | | | |
|---|---|---|---|
| 321,957 | 7/1885 | Enoch | 54/24 |
| 551,375 | 12/1895 | Green et al. | 54/24 |
| 778,511 | 12/1904 | Spohn | 54/24 |
| 904,321 | 11/1908 | Farrar | 54/24 |
| 925,372 | 6/1909 | McClintock | 54/24 |
| 1,536,507 | 5/1925 | Lawson | 54/24 |
| 1,580,553 | 4/1926 | Brenny | 54/24 |
| 1,939,107 | 12/1933 | Grandall | 54/24 |
| 3,407,568 | 10/1968 | Henry | 54/24 |
| 3,418,787 | 12/1968 | Smith | 54/24 |

*Primary Examiner*—Louis G. Mancene
*Assistant Examiner*—J. Q. Lever
*Attorney, Agent, or Firm*—Wells, St. John & Roberts

[57] ABSTRACT

A halter for training horses includes circumferentially expandable and contractible loops for encircling a horses head and nose. Reins operatively and integrally interconnect the loops so that tension applied thereto results in simultaneous circumferential contraction of the loops. Both loops include protuberances strategically located to apply concentrated pressure to selected sensitive areas of the head and nose in response to pulling force on the reins.

19 Claims, 2 Drawing Figures

ANIMAL TRAINING HALTER

BACKGROUND OF THE INVENTION

This invention is related basically to the field of animal training halters and more particularly to such halters utilized in nonriding training procedures for equine.

Many different style halters have been utilized in the past to aid in both riding and nonriding training procedures. In the past, most all bitless halters (whether riding or nonriding training halters) make use of two loops; one extending about the nose of the animal, and the other extending either about the neck or from the poll to the chin groove. Regardless of the configuration of conventional halters, all are utilized to exert a downward force against the poll and/or the bridge of the nose as a discipline measure for training purposes. Often such bitless training halters have proved relatively ineffective in training, mainly because the topographical areas at which the halter applies the downward force are relatively strong insensitive areas (the bridge of the nose and poll). Such insensitivity requires a maximum amount of force to make the animal to respond appropriately.

U.S. Pat. No. 925,372 discloses a halter formed by two individual basic loops. A first loop extends about the animal's nose and the second loop extends from the poll downwardly under the jaws and along the chin groove to intersect with the first loop in a sliding engagement. A single rein member is fixed to the first loop and extends through the sliding hoop of the second loop to provide control for training purposes. Once a pulling force is applied to the rein, the first loop is contracted around the animal's nostrils and the second loop is elongated to impart a strong downward pull on the head of the animal. It has been determined that cutting off the air passage of the nostrils is not an effective way to train animals since such a procedure usually induces panic.

Similar arrangements to that disclosed above is illustrated in the McClintock and Farrar U.S. Pat. Nos. 925,372 and 904,321. These halters feature the use of several slidable loops connected together to comprise a halter for fitting about an animal's head with the control rein located adjacent the chin groove. A third loop is slidably attached to the first and second loops to extend over the bridge of the nose, along the crest of the cheek and over the poll. Operation of these halters are similar to that of the above described halter. An additional provision of these devices, however, is the use of connecting rings to secure the third loop to the first and second loops. These rings are provided to permit adjustment of the loops relative to each other to lengthen or shorten the side piece of the "throat latch" to accommodate the halter to different animals.

U.S. Pat. No. 357,643 to C. B. Thummel and Mitchell discloses a halter comprised of two straps interconnected by a rope folded over on itself to form a nose loop and a head loop with adjoining cheek members. Again in this patent, the rein member is located, when on the animal, adjacent the chin groove.

It is a primary object of the present invention to provide a training halter that will greatly improve efficiency in training procedures for animals by selective contraction of the halter to apply force against various areas over selected nerves within the animal's head and nose.

An additional object of the invention is to provide a training halter that automatically contracts and expands in response to the movement of the horse's head to provide a direct action-response behavioral training device.

A further object is to provide such a halter that includes a first and second loop for encircling the head and nose respectively and rein members which, when appropriate tension is applied therethrough, will simultaneously contract the loops to a smaller circumferential size about the animal's head.

It is a further object of the present invention to provide a training halter that is not necessarily required to be constructed of material of strength properties previously required for halters of a similar nature.

It is a yet further object to provide such a training halter that is very simple in construction and therefor inexpensive to purchase.

These and further objects and advantages will become apparent upon reading the following disclosure, which, taken with the accompanying drawing describe a preferred form of the present invention.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
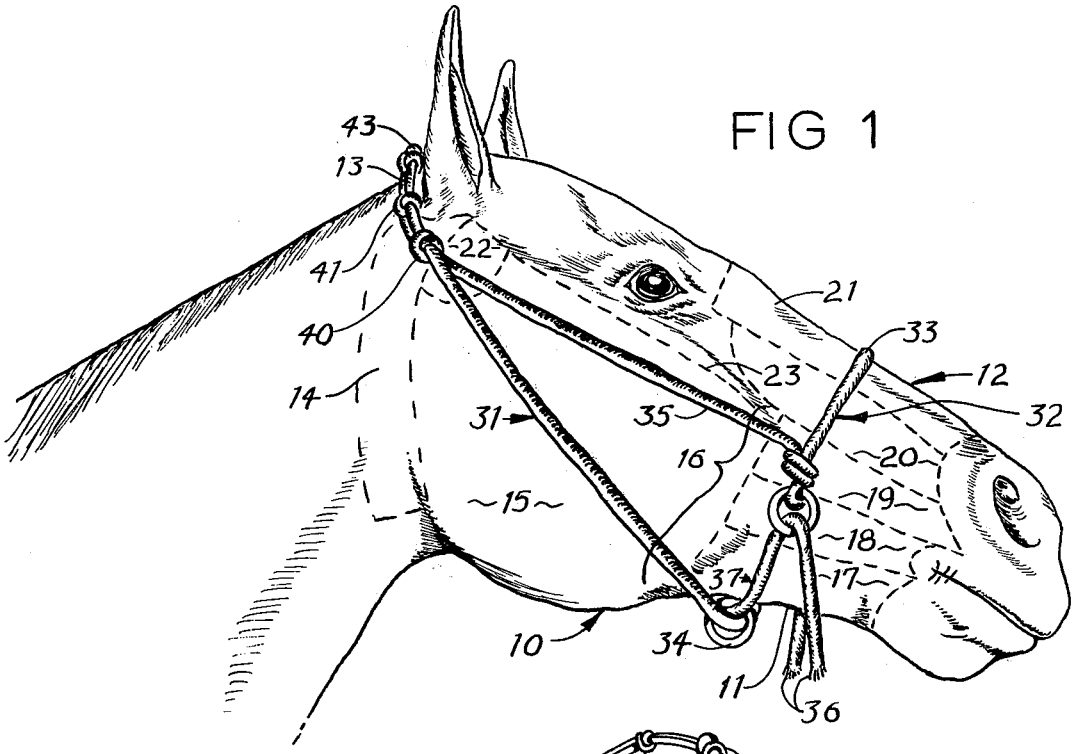
FIG. 1 is a side elevational view of the present halter invention shown on a horse head.

The present invention may be utilized with any animal, it being preferred that the halter be utilized primarily in the training of horses. The present halter, is intended to fit about a horse's head and nose as illustrated in FIG. 1 of the drawings. The head section is designated generally in the drawing by the reference character 10. Head section 10 as utilized herein is defined as that section of the horse includng poll region 13 adjacent to the ears, parotid regions 14 ventral to the ears, the masseteric regions 15, and the posterior end of chin groove 11 adjacent masseteric regions 15.

The nose is generally indicated by 12 and for the purposes of this disclosure is intended to include a cheek region 16, a lateral nose region 20, and a nose bridge portion 21. The cheek region 16 may be broken down into three subregions comprising a mandibular subregion 17, molar subregion 18, and maxillary subregion 19. In addition, for purposes of explanation, a cheek crest is generally located at 23 extending along the head from the ears to the cheek regions 16.

Figure 2:
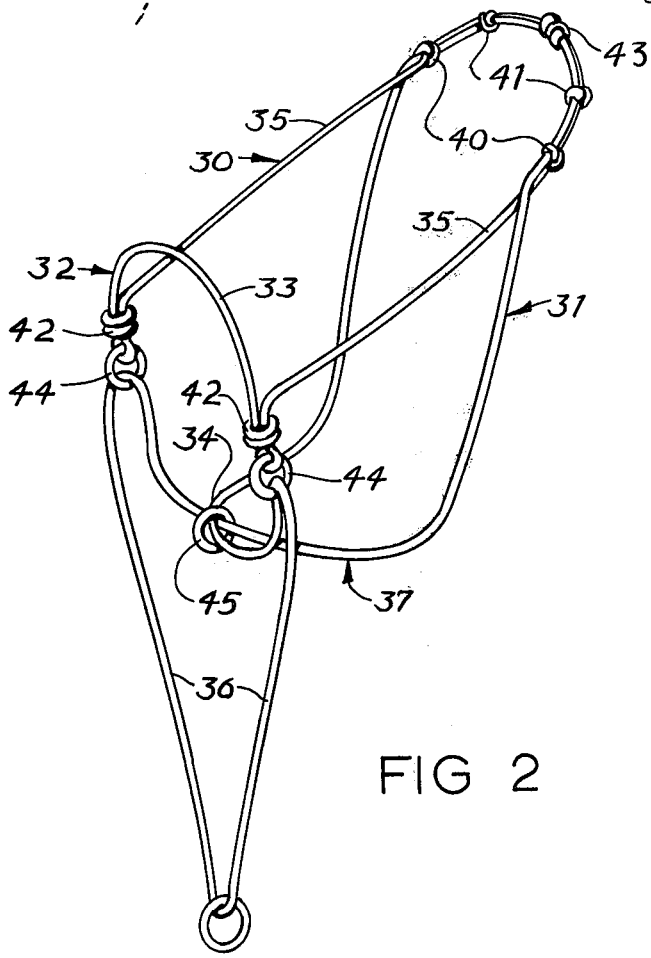
FIG. 2 is a pictorial view of the halter in the configuration it would normally conform to when mounted to an animal's head.

The halter of the present invention is indicated generally by the reference character 30 in FIGS. 1 and 2. Halter 30 may be constructed of rope, cable or other flexible material. Preferably, halter 30 is constructed of ordinary braided rope that is so constructed as to not chaff the animal's skin. Other construction materials include braided rawhide and/or a plastic coated metal cable.

Halter 30 is constructed in a contractible and expandable "figure 8" configuration with a first loop 31 that encircles head 10, and a second loop 32 that encircles nose 12. First loop 31 and second loop 32 are integrally interconnected with one another at a crisscross intersection 34 located adjacent chin groove 11 when the halter is fitted to an animal's head as illustrated in FIG. 1.

Second loop 32 which encircles nose 12, extends from the crisscross 34 transversely across the ventral surface of mandibular subregion 17 and then dorsally across the molar subregions 18, maxillary subregions 19, lateral nose region 20 and finally transversely across the bridge of the nose 21.

Second loop 32 is comprised of a nose band 33 that extends transversely over the nose bridge 21 to opposite sides of nose 12. The remainder of second loop 32 is comprised of the halter elements connected to the ends of nose band 33 and leading to crisscross intersection 34. Cheek members 35 are also provided that extend between loop 31 and the ends of nose band 33 substantially along cheek crest 23. Reins 36 are also provided that depend loosely from ring members 44 provided on either end of the nose band 33.

First loop 31 is shown with a lateral section extending transversely over the poll 13 to both sides of head 10. Diagonal sections of loop 31 then extend ventrally and anteriorly along opposite sides of the head across the parotid and masseteric regions 14 and 15. Upon reaching mandibular subregion 17, the loop turns inward to chin sections transversely extending across the chin groove 11 or ventral surface of mandibular subregion 17, toward crisscross intersection 34.

Halter 30 may also be described as being comprised of two basic elements nose band 33, and a control means 37. Control means 37 includes the remainder of halter 30 extending from nose band 33 to partially encircle the nose and then extend to completely encircle head 10. More particularly, control means 37 extends from opposite ends of nose band 33 adjacent the molar subregions 18, ventrally to chin groove 11 to cross over on itself at crisscross intersection 34. The control means then extends to opposite sides of head 10 and then dorsally and posteriorly across masseteric regions 15, parotid regions 14, and finally across poll 13. As illustrated, the control means is integral with rein members 36 and is slidably engaged with opposed ends of nose band 33 through ring members 44.

It may be easily understood that a pulling force on rein members 36 results in simultaneous circumferential contraction (closing of the loops) of the rein portion extending about the nose 12 (loop 32) and the circumferential portion extending about the horse's head (loop 31).

Crisscross intersection 34 and the location of rings 44 along the opposite sides of nose 12 facilitate this simultaneous contraction. Further, this arrangement enables simultaneous and free circumferential expansion of the halter as tension is released from the reins 36.

It is important to note that the halter is contracted circumferentially about the nose and head since the rope comprising the loops is made shorter as reins are pulled through rings 44. The location of rings 44 facilitates both vertical and horizontal contraction of second loop 32 about nose 12. With the present arrangement, crisscross 34 is pulled upwardly toward rings 44 as tension is applied to reins 36. Nose band 33 is pulled simultaneously ventrally and therefor second loop 32 contracts circumferentially about the nose 12 in an efficient and effective manner.

The provision and location of rings 44 and crisscross intersection 34 also assist in circumferential contraction of the first loop about head 10. Crisscross intersection 34 is so located that pulling force through the rein 36 on one side of the head 10 is transferred to the opposite side of the head through the crisscross intersection 34. A simultaneous pulling force on both reins 36 serves to circumferentially contract the loops horizontally as well as vertically about the head 10 to apply relative uniform inward pressure against nerves of the head and nose to control the behavior of the animal in a direct action-response mode.

In addition to the advantages provided by applying a rather uniform inward pressure about the head and nose by the automatically contracting and expanding loops, further important features are provided in the form of protuberances or knots 40, 41 and 42 about the halter. These protuberances are strategically located about the halter so, when fitted to a horse's head, each knot is located adjacent to and exterior of a selected sensitive nerve. The first pair of knots 40 are positioned to fit on either side of poll 13 slightly ventral to the ears within parotid region 14. This location is in close proximity to the facial nerves and, when the halter is contracted by applying a pulling force on reins 36, knots 40 are forced inwardly against the facial nerves causing additional discomfort to the horse to control its behavior.

The second pair of knots 41 are also positioned to fit along poll region 13. Knots 41 upon contraction of first loop 31, press against the great auricular and second cervical nerves. Provision of the second pair of knots 41 aids and supplements the effects provided by the first knots 40.

A retaining means or central knot 43 is provided to fit or straddle the crest of poll 13. Knot 43 is utilized to hold first loop 31 in place, preventing mislocation of knots 40 and 41. An alternative to knot 43 is to provide a spaced pair of knots (not shown) to be located on opposite sides of the poll crest.

In addition to first and second protuberances or knots 40 and 41 and additional pair of protruberances or knots 42 are provided at the ends of nose band 33. Knots 42 are located within the maxillary subregions 19 and are strategically positioned adjacent to and exterior of the infraorbital nerve and dorsal buccal branches of the facial nerves. Knots 42 are operative upon circumferential contraction of second loop 32 to apply additional pressure inwardly against the adjacent nerves to cause corresponding discomfort to the horse.

As described above, all protuberances are provided in the form of knots located strategically about the halter and formed of the halter material. It is well understood, however, that these protuberances may alternatively be provided in the form of buttons or other similar devices to direct a concentrated pressure at the selected areas of the animal's head in order to apply pressure to various selected nerves or branches thereof.

In operation, the halter is fitted to the animal's head as illustrated in FIG. 1. When reins 36 are held slack, the halter is automatically positioned by the configuration of the animal'head to assume an expanded position. In this condition, the halter creates no objectionable or disturbing pressures against any portion of the animal's head or nose. However, when desired, the reins 36 may be pulled relative to the animal's head to circumferentially contract the halter about the head and nose to contract loops 31 and 32 and corresponding protuberance areas 40, 41 and 42 to consequently apply pressure to the respective nerves and nerve branches in the areas described. This pressure creates substantial discomfort for the animal and such discomfort may be utilized to discourage improper movements such as rearing, kicking, or other undesirable characteristics to be trained away from. The reins 36 may be hand held to be operated selectively by a trainer, or may be tied to a hitching post or other convenient anchor. When so anchored, the halter is utilized to automatically respond to undesired movement by contracting when the animal moves away from the anchor. Horses may be automatically trained not to rear against the halter or back away from the anchor since such movements will result in contraction of the halter and accompanying discomfort to the horse thereby enabling the horse to quickly learn which movements cause automatic discomfort. Each movement is quickly translated into a direct response of contractions (discomfort) or expansion (release of discomfort).

The above description was given by way of example and was not intended to limit the scope of my invention. Only the following claims are to be taken as definitions of my invention.

What I claim is:

1. An animal training halter for automatic expansion and contraction about the head and nose of an animal in response to external tension applied to the halter, comprising first expandable and contractible loop means adapted to encircle the head;

second expandable and contractible loop means adapted to encircle the nose;

the first and second loop means being operatively interconnected at an intersection in a crisscrossing fashion adjacent the chin groove forming the loops in a figure 8 configuration; and rein means operatively connected to the first and second loop means for automatically circumferentially expanding and contracting the first and second loop means simultaneously in response to release and application of tension to the halter through the rein means.

2. The training halter as set out in claim 1 wherein:

the first loop means encircles the head transversely and diagonally from the crisscross juncture at the chin groove to extend over both masseteric regions on opposite sides of the head to the poll; and the second loop means encircles the nose transversely from the crisscross at the chin groove to extend therefrom over the cheek regions, the lateral regions of the nose, and the bridge of the nose.

3. The training halter as set out in claim 2 wherein the rein means is adapted to connect to the first and second loop means on opposite sides of the nose.

4. The training halter as set out in claim 3 wherein the first loop means includes a first protuberance thereon positioned to apply pressure to the facial nerve upon contraction of the first loop means circumferentially about the head.

5. The training halter as set out in claim 4 wherein the first loop means includes a second protuberance thereon positioned to apply pressure to the auricular nerve and branches of the cervical nerve upon contraction of the first loop means circumferentially about the head.

6. The training halter as set out in claim 5 wherein the second loop means includes a protuberance thereon positioned to apply pressure to branches of the facial nerve and the infraorbital nerve upon contraction of the second loop means circumferentially about the nose.

7. The training halter as set out in claim 3 wherein the second loop means includes a protuberance thereon positioned to apply pressure to branches of the facial nerve and the infraorbital nerve upon contraction of the second loop means circumferentially about the nose.

8. The training halter as set out in claim 1 further comprising:

a cheek member for extending between the first and second loop means longitudinally along the crest of the cheek.

9. The training halter as set out in claim 6 further comprising:

a cheek member for extending between the first protuberance on the first loop means, along the crest of the cheek to the protuberance on the second loop means; and retaining means for holding the first loop against sliding movement about the head.

10. An animal training halter for automatic expansion and contraction about the head and nose of an animal in response to external tension applied to the halter, comprising:

a noseband portion for extending transversely over the bridge of the nose;

control means interconnected to the nose band on one side of the nose for extending therefrom ventrally toward the ventral surface of the mandibular subregion, transversely across the chin groove, dorsally and posteriorally along the opposite side of the nose, across the masseteric region and parotid region to the poll, transversely over the poll and thence ventrally and anteriorally along the one side of the head across the parotid and masseteric regions toward the ventral surface of the mandibular subregion, then on transversely to crisscross with itself on the ventral surface of the mandibular subregion adjacent the chin groove, and subsequently dorsally again to interconnect with the nose band on the opposite side of the nose, rein means integral with the control means and leading from the interconnections of the nose band and control means for enabling selective circumferential contraction and expansion of the halter about the head through application of tension to the halter through the interconnections of the control means and nose band.

11. The training halter as set out in claim 10 wherein the control means includes a first protuberance thereon ventral to and adjacent the ear to apply pressure to the facial nerve upon contraction of the halter circumferentially about the head and nose.

12. The training halter as set out in claim 10 wherein the control means includes a second protuberance thereon positioned posterior to and adjacent the ear to apply pressure to the auricular nerve and branches of the cervical nerve upon contraction of the halter circumferentially about the head and nose.

13. The training halter as set out in claim 11 wherein the control means includes a second protuberance thereon positioned posterior to and adjacent the ear to apply pressure to the auricular nerve and branches of the cervical nerve upon contraction of the halter circumferentially about the head and nose.

14. The training halter as set out in claim 10 wherein the nose band includes a protuberance thereon adjacent the maxillary subregion to apply pressure to branches of the facial nerve and the infraorbital nerve upon contraction of the halter about the head and nose.

15. The training halter as set out in claim 11 wherein the nose band includes a protuberance thereon adjacent the maxillary subregion to apply pressure to branches of the facial nerve and the infraorbital nerve upon contraction of the halter about the head and nose.

16. The training halter as set out in claim 12 wherein the nose band includes a protuberance thereon adjacent the maxillary subregion to apply pressure to branches of the facial nerve and the infraorbital nerve upon contraction of the halter about the head and nose.

17. The training halter as set out in claim 13 wherein the nose band includes a protuberance thereon adjacent the maxillary subregion to apply pressure to branches of the facial nerve and the infraorbital nerve upon contraction of the halter about the head and nose.

18. The training halter as set out in claim 10 further comprising:

a cheek member interconnecting the nose band and control means on opposite sides of the head, extending along the crest of the cheek from the nose band adjacent the interconnections of the control means and nose band to the control means at a position adjacent the poll ventral to the ears.

19. The training halter as set out in claim 17 further comprising:

a cheek member interconnecting the nose band and control means on opposite sides of the head, the cheek member being connected to the nose band adjacent the protuberance thereon and the control means adjacent the first protuberance thereon.

* * * * *